US005131757A

United States Patent [19]

Smith

[11] Patent Number: 5,131,757

[45] Date of Patent: Jul. 21, 1992

[54] MIXING APPARATUS AND SYSTEM

[75] Inventor: William H. Smith, McMurray, Pa.

[73] Assignee: Hazleton Environmental Products Inc., Hazleton, Pa.

[21] Appl. No.: 666,137

[22] Filed: Mar. 7, 1991

[51] Int. Cl.[5] ..... B01F 15/02

[52] U.S. Cl. ..... 366/165; 366/173; 261/118; 261/44.8

[58] Field of Search ..... 366/163, 165, 167, 177, 366/150, 173, 174; 261/118, 64.1, 44.8, 76, DIG. 75

[56] References Cited

U.S. PATENT DOCUMENTS

| | | | |
|---|---|---|---|
| 1,275,032 | 8/1918 | Huene | 261/64.1 |
| 2,022,957 | 12/1935 | Drovin | 261/64.1 |
| 4,019,720 | 4/1977 | Levesque et al. | 261/DIG. 75 |
| 4,043,766 | 8/1977 | Gernhardt et al. | 366/165 |
| 4,085,463 | 4/1978 | Wilson | 366/336 |
| 4,164,541 | 8/1979 | Platz et al. | 261/76 |
| 4,398,827 | 8/1983 | Dietrich | 366/165 |
| 4,647,212 | 3/1987 | Hankison | 366/165 |
| 4,954,147 | 9/1990 | Galgon | 366/165 |
| 5,004,484 | 4/1991 | Stirling | 261/DIG. 75 |
| 5,011,293 | 4/1991 | Roop et al. | 366/173 |

*Primary Examiner*—Philip R. Coe
*Assistant Examiner*—Tony Soohoo
*Attorney, Agent, or Firm*—William J. Ruano

[57] ABSTRACT

Mixing apparatus comprising a pair of detachable, spaced rings,—one having inlet passages skewed in a direction to cause clockwise rotation of the exiting fluid, and the other skewed in an opposite direction to cause counter-clockwise rotation thereof, to cause shear action and intense mixing of fluid therebetween. Pairs of mixers may be arranged in different relative positions in either an open or closed body of liquid to effect mixing of effluent therein.

11 Claims, 4 Drawing Sheets

MIXING APPARATUS AND SYSTEM

This invention relates to a mixing apparatus and system mixing liquid with a liquid, gas, a dry granular or powder material, solids in a slurry or a suspension, or with combinations thereof.

BACKGROUND OF THE INVENTION

The present invention is an improvement over U.S. Pat. No. 4,474,477 dated Oct. 2, 1984, in which I was a joint inventor, and U.S. Pat. No. 4,761,077 in which the mixing chamber is very confined, therefore incapable of mixing large bodies of liquid. Moreover, its mixing capability is limited by skewing of inlet passages in only one direction. Also the amount of air intake is limited and not variable.

SUMMARY OF THE INVENTION

An object of the present invention is to-overcome the above-mentioned restrictive limitations of the mixer of said patent by providing one or more mixers which discharge into a separate body of liquid of substantially greater volume than the mixer and which, by various arrangement of mixers, thoroughly mixes such separate body of liquid.

Another object is to increase the mixing capabilities of the mixer by providing spaced, detachable skewing rings having inlet passages skewed in opposite directions downwardly towards the outlet end.

Still another object is to increase the air intake and to make it variable by providing variable openings in the surrounding cylinder.

BRIEF DESCRIPTION OF THE DRAWINGS

Referring to the drawings.

DETAILED DESCRIPTION OF THE PREFERRED EMBODIMENTS

Figure 1:
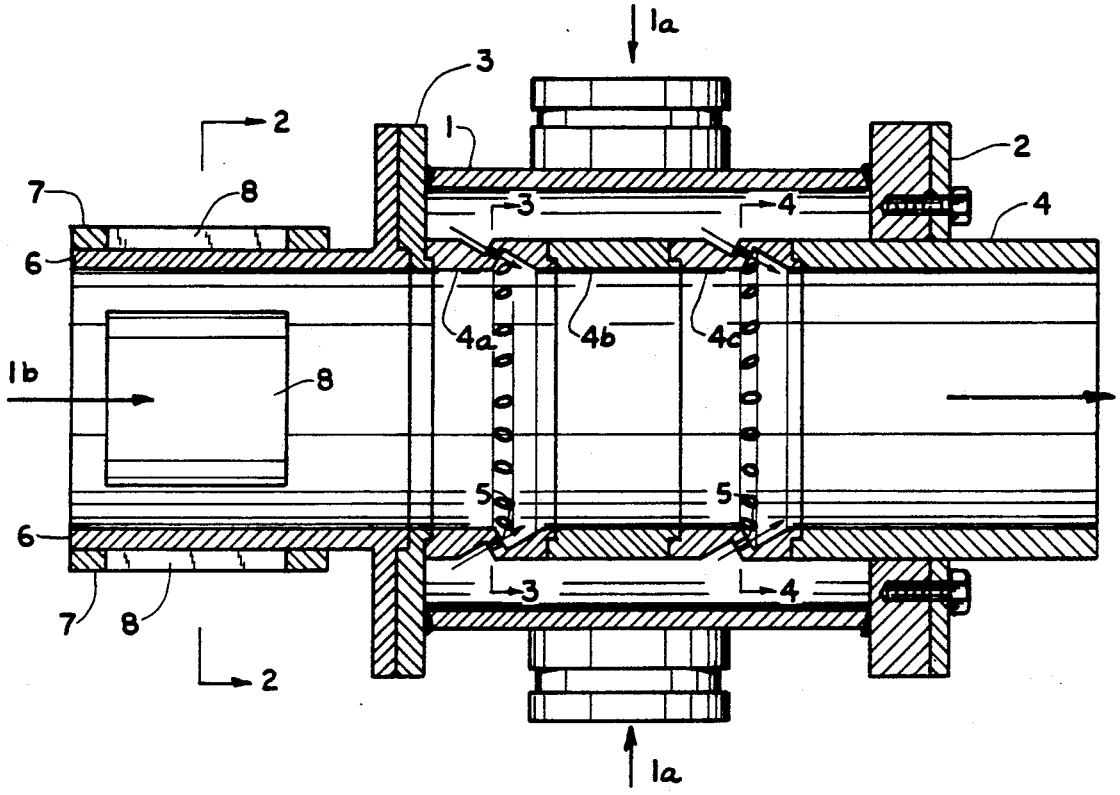
FIG. 1 is a horizontal cross-sectional view of a typical mixer, embodying detachable orifice rings having inlet openings skewed alternately for clockwise and counterclockwise rotation, or spin of the water, respectively.
Figure 2:
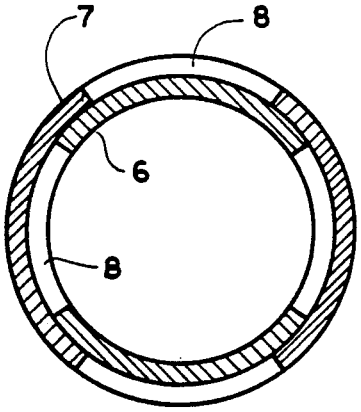
FIG. 2 is a cross-sectional view of the bore piece taken along line 2—2 of FIG. 1 showing an adjustably rotatable register to vary the size of the opening for air entry of the mixer shown in FIG. 1.
Figure 3:
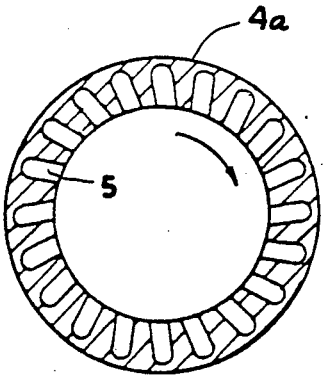
FIG. 3 is a vertical sectional view taken along line 3—3 of FIG. 1 which shows the spinning of liquid, air, gas or solid clockwise as the result of a particular skewing to the right of the passages in the bore ring 4*a* of FIG. 1.
Figure 4:
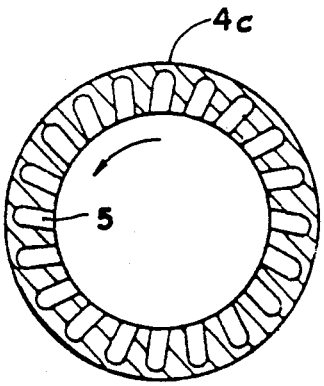
FIG. 4 is a vertical sectional view taken along 4—4 of FIG. 1 showing inlet passages skewed to the left so as to effect counterclockwise rotation of the fluid i the bore ring.

Referring more particularly to FIG. 1 showing the mixing apparatus, numeral 1 denotes an outer cylindrical jacket having water entry openings 1*a*, an annular forward end wall 2 and an annular rearward end wall 3 and an interior cylindrical mixing chamber 4 including detachable rings 4*a*, 4*b* and 4*c*. Rings 4*a* and 4*c* have inlet passages 5 which are at an angle of about 25° toward the outlet end of the mixing chamber and which are angularly skewed about 8° relative to the axis of the mixing chamber surrounded thereby in the direction of the outlet in FIG. 1. Ring 4 is a spacer ring having no inlet passages. Rings 4*a* and 4*c* are skewed in a different direction, relative to the axis of the mixing chamber and outlet. For example, ring 4*a* may have inlet passages 5 skewed to the right as shown in FIG. 3 for obtaining clockwise rotation of liquid in the mixing chamber as shown by the arrow. Ring 4*c*, as shown in FIG. 4, has inlet passages 5 skewed to the left to obtain counterclockwise rotation of fluid for such other direction of skewing, as shown by the arrow which fluid may be air, gas or solids.

The result of both clockwise rotation of the liquid in ring 4*a* followed by counterclockwise rotation thereof in ring 4*c* is to effect a high shear and mixing action in spacer ring 4*b* which will improve the overall mixing action in mixing chamber 4. This will improve solubilization and mixing action of liquidous, dry gases etc. or any combination thereof to create a body of processed liquid which can be fed into and agitate and effect mixing action in a separate body of water:as will appear more fully hereinafter. Such mixing action of the separate body of water may be best effected when two or more mixers are positioned in cooperative relationship as will also appear more fully hereinafter.

Since the air entry opening 1*b*, at the left, is too small for some applications requiring more effective oxidation, two relatively rotatable cylindrical sleeves 6 and 7 may be provided, each having a pair of opposing windows 8 which can be turned into registry, to obtain maximum air entry, or out of registry, as shown in FIG. 1, to close windows 8, or in-between, to obtain a smaller and variable amount of air opening.

Additional pairs of rings, such as 4*a* and 4*c* with a spacer ring, such as 4*b*, may be added. Also rings 4*a* and 4*c* may be skewed in the same direction for some applications and spacer rings 4*b* may be omitted in other applications.

Any other combination of rows of perforations having different skewing angles may be made, such as two rows of counterclockwise and one row of clockwise or one row of counterclockwise, and two rows of clockwise, etc.

While a skew angle of about 8° relative to the longitudinal center line and an entry angle of about 25° with respect to the horizontal is described for the inlet passages. They may be larger or smaller in some applications.

Figure 5:
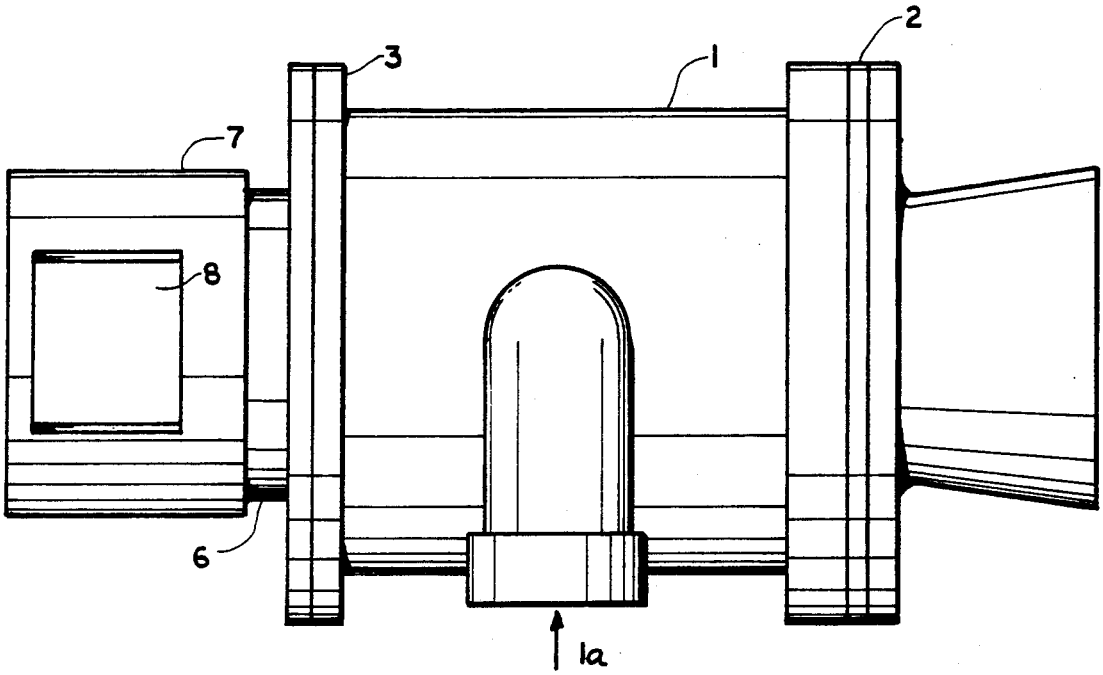
FIG. 5 is a plan view of the mixer shown in FIG. 1.
Figure 5A:
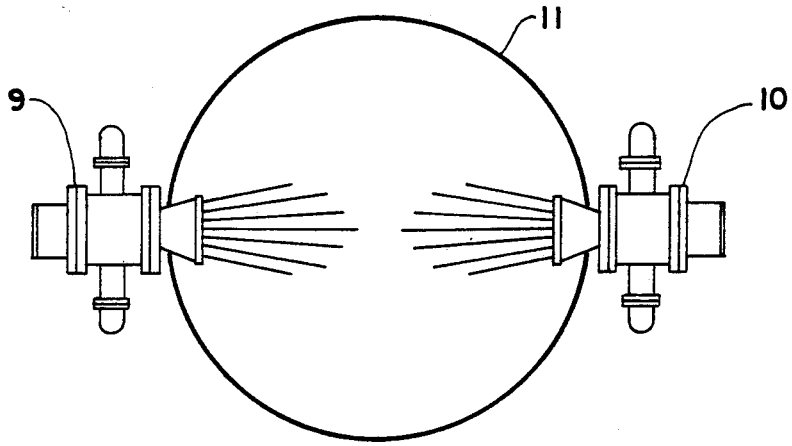
FIG. 5*a* is a top view.
Figure 6:
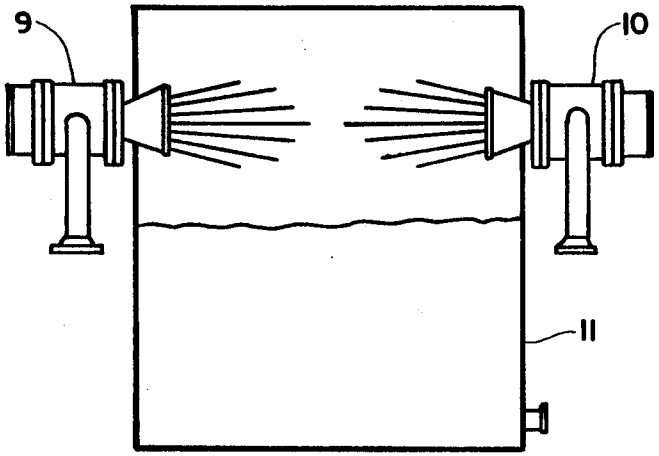
FIGS. 6 and 7 are elevational views showing a pair of mixers' such as of the construction shown in the above mentioned patent or in FIG. 1, in confronting and downwardly inclined relationship, respectively.

FIG. 5*a* is a top view and FIG. 6 is a vertical cross-sectional view of a pair of diametrically opposed mixers 9 and 10 of the above-described type in an enclosed chamber. Their orifices may be skewed either in the same direction, to obtain clockwise flow in the outlet, or in opposite directions, to obtain clockwise flow on one side of an open reaction chamber 11 and either clockwise or counterclockwise flow on the other side.

Figure 7:
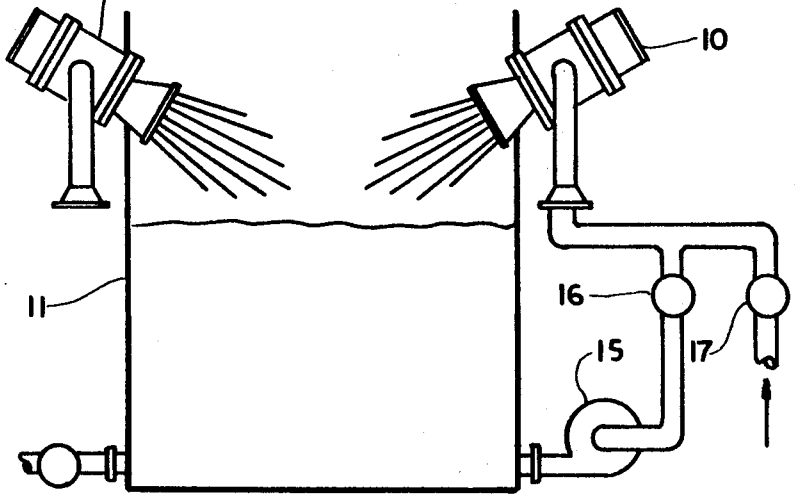

FIG. 7 is a vertical cross-sectional view showing mixers 9 and 10 tilted downwardly onto the surface of the open reaction chamber and a recirculating pump 15 and valves 16 and 17 for returning processed liquid to the mixer and open mixing chamber for further processing. FIG. 7 may be totally enclosed like FIG. 6 in some instances.

Figure 8:
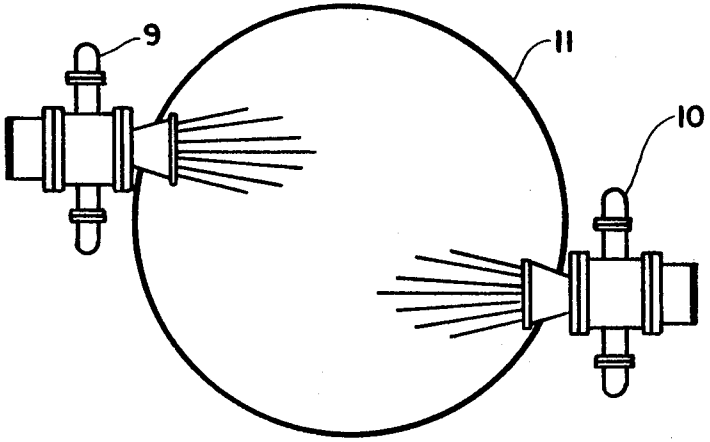
FIG. 8 shows a top view of a modification in which the mixers are laterally offset.

FIG. 8 is another modification showing mixing chambers 9 and 10 laterally offset to obtain more effective clockwise or counter-clockwise rotation of liquid in reaction chamber 11.

In some instances, instead of having the mixers 9 and 10 stationary, they may be oscillated vertically or horizontally by a well known mechanism, such as used for oscillating fans, to get even more thorough mixing in the reaction chamber.

In still other instances, the outlets of mixers 9 and 10 may be submerged in the liquid of the open or closed reaction chamber, in which instance the outlets may be either stationary or oscillatory.

Figure 9:
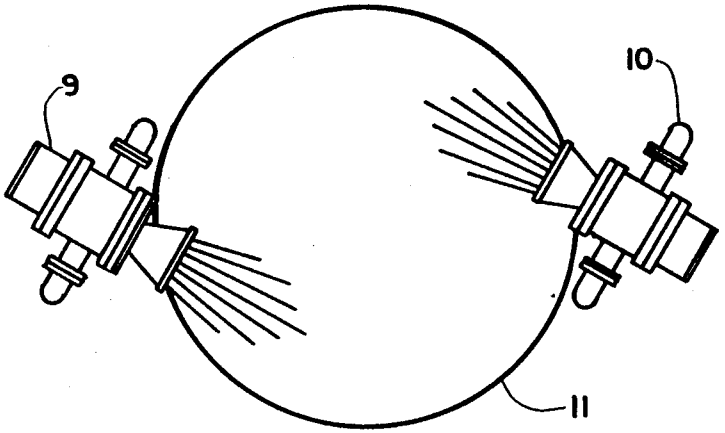
FIG. 9 shows tangential positioning thereof.

FIG. 9 shows still another modification of FIG. 8.

Figure 10:
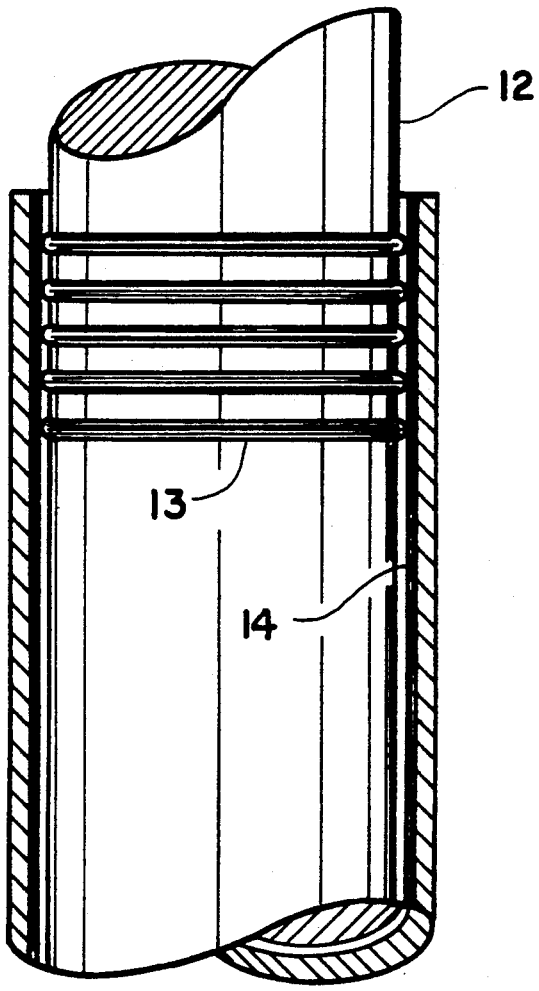
FIG. 10 is a vertical cross-sectional view of a feed post on a yoke to allow pivotal and elevation adjustment of a mixer (not shown) mounted thereon.

FIG. 10 shows a feed post 12 having 0 ring seals 13 surrounded by a sleeve 14 to allow elevation or rotational adjustment of the mixer which is mounted thereon. (not shown).

Referring to FIG. 1, while the inlet of sleeve 6 is. shown open, it can be either closed or partially open allowing the side openings or windows 8 to effect registration with the rotary sleeve 7 thereby directing the aspirated air through an entry system that can be controlled. Restriction of aspirated air causes turbulence within the mix chamber.

What is claimed is:

1. Mixing apparatus including an elongated cylindrical mixing chamber which is open at one end for admitting inlet air, a cylindrical inlet sleeve attached to said open end and having a peripheral opening, a rotary sleeve telescopically slidable with said cylindrical inlet sleeve and having a window on its periphery to selectively effect registration with said peripheral opening to vary the amount of inlet air entering through said peripheral opening and window, a water jacket surrounding said mixing chamber having end walls engaging the exterior of said mixing chamber, water inlet opening means in said water jacket, a pair of spaced rings of inlet opening means in said water jacket, a pair of spaced rings of inlet passages extending through the wall of said mixing chamber, each of said inlet passages of said pair of spaced rings of inlet passages extending at an angle of about 25° toward the other end of said mixing chamber serving as the outlet end, each inlet passage of one of said pair of rings being angularly skewed about 8° in one direction relative the longitudinal axis of said mixing chamber, and each inlet passage of the other of said pair of spaced rings of inlet passages being skewed in an opposite direction, and fluids passing through said other of said pair of rings of inlet passages will have a rotary component in an opposite direction to effect a shear action and intensive mixing of fluids between said pair of rings of inlet passages.

2. Apparatus as recited in claim 1 wherein said angle of said inlet passages is about 25° and the angle of skewing is about 8°.

3. Apparatus as recited in claim 1 wherein said pair of spaced rings of inlet passages are one separate, laterally detachable, interfitted rings.

4. Mixing apparatus of the construction recited in claim 1 in combination with an open body of liquid into which said outlet end of said mixing chamber discharges.

5. A pair of mixing apparatus as recited in claim 4 having outlet ends of said mixing chambers which discharge into said open body of liquid to effect turbulence of said open body of liquid.

6. Apparatus recited in claim 5 wherein said outlet ends of said mixing chambers discharge in opposite directions into said open body of liquid.

7. Apparatus recited in claim 5 wherein said outlet ends of said mixing chambers are in laterally offset relationship while discharging into said open body of liquid.

8. Apparatus as recited in claim 5 together with a recirculatory pump connected to said open body of liquid, and to the inlet of said mixing chamber for additional mixing and aeration.

9. Apparatus as recited in claim 8 in which said open body of liquid is enclosed by a container of solid material.

10. Mixing apparatus as recited in claim 1 in combination with an enclosed body of liquid into which said outlet end of said mixing chamber discharges.

11. Mixing apparatus as reicted in claim 5 wherein said outlet ends of said mixing chambers discharge in angularly downward relationship onto said open body of liquid.

* * * * *